US005743759A

United States Patent [19]

Pudims et al.

[11] Patent Number: 5,743,759

[45] Date of Patent: Apr. 28, 1998

[54] ELECTRICAL CONNECTOR WITH SUBSTANTIALLY FLUSH MOUNTED CORD SEAL

[75] Inventors: Albert A. Pudims, Stratford; Thomas J. Vigorito, Fairfield, both of Conn.

[73] Assignee: Hubbell Incorporated, Orange, Conn.

[21] Appl. No.: 721,632

[22] Filed: Sep. 26, 1996

[51] Int. Cl.[6] ..... H01R 13/58

[52] U.S. Cl. ..... 439/462; 439/469; 439/589

[58] Field of Search ..... 439/462, 584, 439/587, 589, 274, 275, 279, 469

[56] References Cited

U.S. PATENT DOCUMENTS

| | | | |
|---|---|---|---|
| 3,437,980 | 4/1969 | Smith | 439/469 |
| 4,304,455 | 12/1981 | McLaughlin et al. | 439/469 |
| 5,135,404 | 8/1992 | Clark et al. | 439/469 |
| 5,618,198 | 4/1997 | Sato et al. | 439/274 |

OTHER PUBLICATIONS

GE Wiring Devices, Full Line Catalog, GEP-950, Apr. 1989

IDA ©1989 "Locking Devices", p. C4.

Hubbell, Catalog 2000, ©1995, "Wiring Devices & Systems", Kellems Wire Management, Marine Wiring Products, pp. M-15, M-17, F-5, A-23, A43.

Bryant, Wiring Device Catalog BDB-1506, printed May 1994, B2, B3, H2, H10.

Photographs of the Arrow Hart plug with removable cord seal. Sold prior to Sep. 26, 1996.

*Primary Examiner*—Neil Abrams

*Assistant Examiner*—T. C. Patel

*Attorney, Agent, or Firm*—Jerry M. Presson; David L. Tarnoff

[57] ABSTRACT

An electrical connector with a cord seal is disclosed for attachment to an end of an electrical cord to prevent dust, moisture and other foreign matter from entering the electrical connector. The electrical connector preferably a connector body with a plurality of electrical contacts mounted therein, and cover coupled to the connector body. The cover has an end wall with the cord seal mounted therein such that the outer surface of the cord seal is at least substantially flush with respect to the exterior surface of the end wall of the cover to increase the difficulty of removing the cord seal from the opening in the end wall of the cover. In other words, the geometry of the exterior surface of the end wall of the cover blends with the geometry of the outer surface of the cord seal. The electrical connector can be either a male or a female electrical connector.

15 Claims, 6 Drawing Sheets

FIG. 6
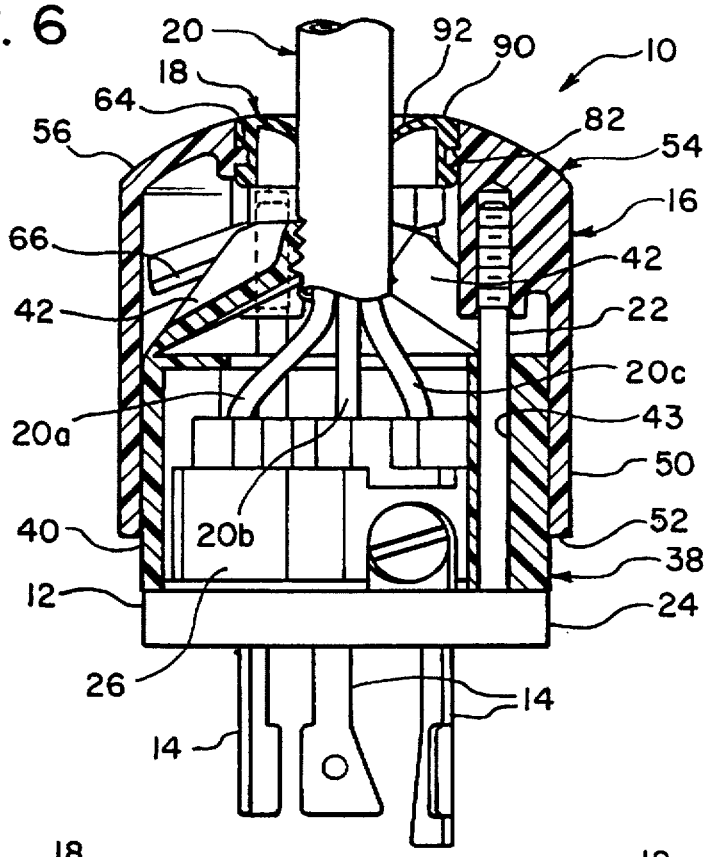
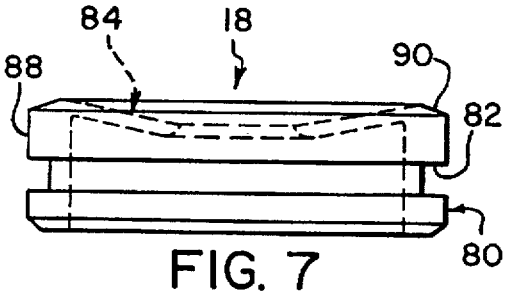
FIG. 7
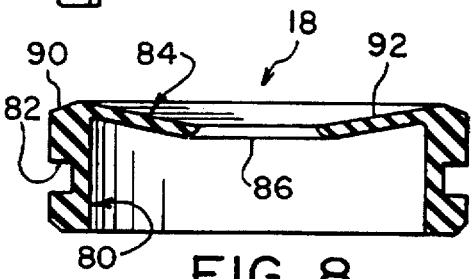
FIG. 8
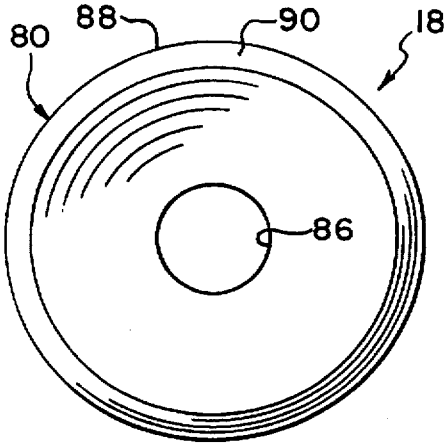
FIG. 9
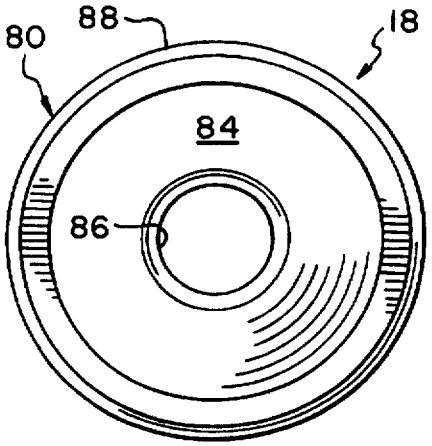
FIG. 10

ELECTRICAL CONNECTOR WITH SUBSTANTIALLY FLUSH MOUNTED CORD SEAL

FIELD OF THE INVENTION

The present invention generally relates to male and female electrical connectors having a cord seal mounted in an opening of the cover for the electrical connector. More specifically, the present invention relates to a cord seal which is substantially flushly mounted within the cord opening of the cover of the electrical connector so that the geometry of the cover of the electrical connector blends with the geometry of the cord seal.

BACKGROUND OF THE INVENTION

Currently, there are many types of electrical connectors available on the market. Male electrical connectors are typically referred to as plugs, while female electrical connectors are typically just referred to as connectors. The construction of electrical connectors typically depend upon their intended use. For example, the electrical connectors can be straight blade type wiring devices or can be locking type wiring devices.

Most electrical connectors are provided with some type of cord clamp or cord grip for securing one end of the electrical cord to the housing of the electrical connector. These cord clamps or cord grips can take a variety of forms in order to assure proper strain relief between the terminals of the electrical connector and the conductors or wires of the electrical cord. Some cord clamps merely grip the cord to hold it in place, while other types of cord clamps grip and pull the cord into the housing of the electrical connector during assembly thereof to assure maximum strain relief.

In certain applications, it is desirable to provide the electrical connector with a cord seal for preventing dust, moisture and/or other contaminants from entering into the connector housing. Many attempts have been made in the past to seal the interface between the electrical cord and the housing of the electrical connector. One type of cord seal is designed to be positioned within the housing of the electrical connector and pressed against the interior of the housing to create a seal between the exterior of the cord and the interior of the housing of the electrical connector during assembly of the electrical connector. While this type of cord seal performs quite well in certain applications, it also has certain disadvantages. For example, since the cord seal is not attached to the housing, the cord seal can be easily lost during assembly. Moreover, this type of cord seal may not seal properly if the housing of the electrical connector is not fully tightened during assembly.

Cord seals are also known which are attached within the cord opening of the electrical connector housing in which the electrical cord is received. However, these types of cord seals are often too easily removed, and thus, can be subsequently lost. In particular, these prior art cord seals extend outwardly from the housing of the electrical connector and can be accidentally pulled out.

Another method of sealing the interface between the housing of the electrical connector and the electrical cord is to install a weather protective boot over the electrical connector and the end of the electrical cord. While such protective boots are quite effective in preventing moisture, dust and other contaminants from infiltrating into the electrical connector, these types of protective boots are considerably more expensive than a cord seal.

In view of the above, it is apparent that there exists a need for an electrical connector with a cord seal which is not easily removed by accident and which is relatively inexpensive and easy to manufacture. This invention addresses this need in the art as well as other needs in the art which will become apparent to those skilled in the art once given this disclosure.

SUMMARY OF THE INVENTION

One object of the present invention is to provide an electrical connector with a cord seal which is secured within the cord opening in the cover of the electrical connector.

Another object of the present invention is to provide an electrical connector with a flush mounted cord seal which prevents easy removal thereof.

Still another object of the present invention is to provide an electrical connector which is relatively easy and inexpensive to manufacture as well as easy to install.

The foregoing objects are basically attained by providing an electrical connector for attachment to an end of an electrical cord, comprising: a connector body having a plurality of electrical contacts mounted thereto, the contacts being adapted to be coupled to the end of the electrical cord; a cover having a tubular sidewall with a first end and a second end, the first end of the cover being coupled to the connector body and the second end having an inwardly extending end wall with an exterior surface defining a centrally located opening; and a resilient cord seal fixedly coupled within the opening of the cover, the cord seal having an outer peripheral surface engaging the end wall to form a seal therebetween and a centrally located aperture for receiving the end of the electrical cord therethrough to form a seal therebetween, the cord seal having an outer end surface extending between the outer peripheral surface and the aperture, the outer end surface of the cord seal being substantially contiguous with respect to the exterior surface of the cover to increase difficulty of removal of the cord from the opening in the end wall of the cover.

Other objects, advantages and salient features of the present invention will become apparent to those skilled in the art from the following detailed description, which, taken in conjunction with the annexed drawings, discloses two preferred embodiments of the present invention.

BRIEF DESCRIPTION OF THE DRAWINGS

Referring now to the drawings which form part of the original disclosure:

FIG. 6 is a longitudinal cross-sectional view of the electrical connector illustrated in FIGS. 1–5, with the electrical cord and the contact retainer body shown in elevation;

FIG. 7 is an enlarged side elevational view of the cord seal for the electrical connector illustrated in FIGS. 1–6;

FIG. 8 is an enlarged cross-sectional view of the cord seal for the electrical connector illustrated in FIGS. 1–6;

FIG. 9 is an enlarged top end plan view of the cord seal illustrated in FIGS. 7 and 8 for the electrical connector illustrated in FIGS. 1–6;

FIG. 10 is an enlarged bottom end plan view of the cord seal illustrated in FIGS. 7–9 for the electrical connector illustrated in FIGS. 1–6;

DETAILED DESCRIPTION OF THE PREFERRED EMBODIMENTS

Figure 1:
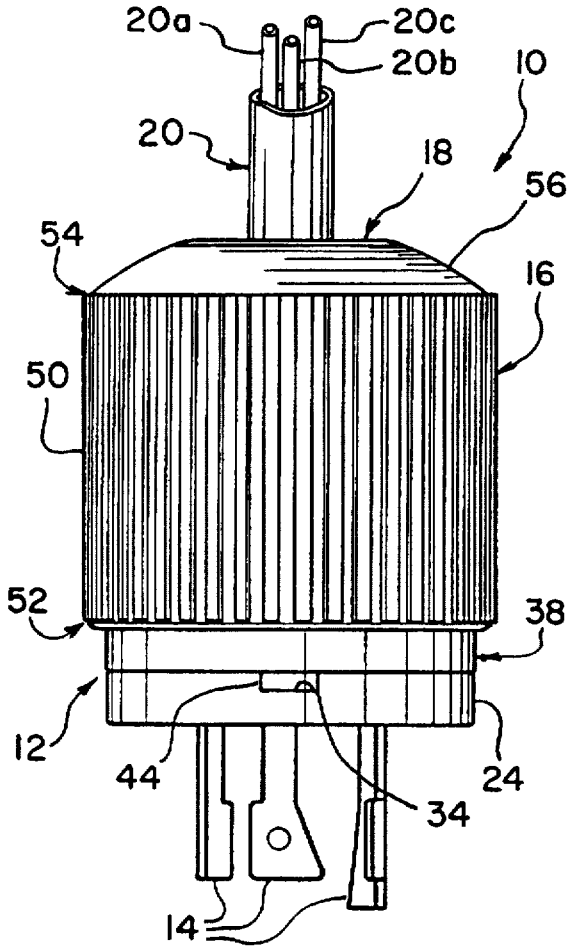
FIG. 1 is a side elevational view of an electrical connector in the form of a plug in accordance with a first embodiment of the present invention.
Figure 2:
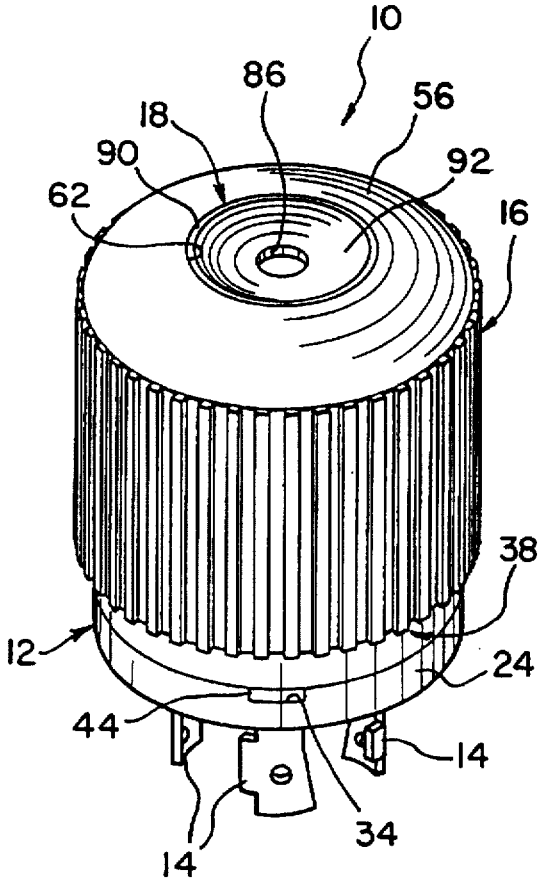
FIG. 2 is a top end perspective view of the electrical connector illustrated in FIG. 1 with the electrical cord removed.
Figure 3:
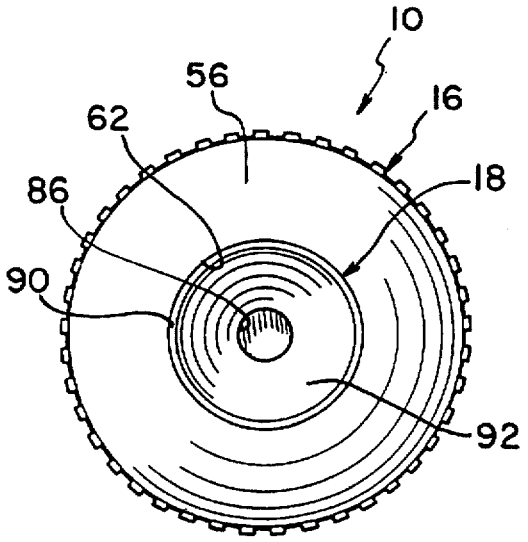
FIG. 3 is a top end plan view of the electrical connector illustrated in FIGS. 1–2 with the electrical cord removed.

Referring initially to FIGS. 1–5, an electrical connector 10 in the form of a plug in accordance with the present invention is illustrated. Electrical connector 10 basically includes a contact retainer body 12 with three electrical contacts 14 coupled thereto, a cover 16 releasably coupled to contact retainer body 12 and a cord seal 18 coupled to cover 16. Electrical connector 10 is electrically coupled to the end of an electrical cord 20 in a substantially conventional manner as mentioned below. While electrical connector 10 is illustrated as a male electrical connector or a plug, it will be apparent to those skilled in the art once given this disclosure that the subject invention can be constructed in the form of a female electrical connector as mentioned below and illustrated in FIGS. 14–18.

Electrical cord 20 is preferably a multi-conductor cable having three individually insulated conductors 20*a*, 20*b* and 20*c* with exposed ends for electrical connection with electrical contacts 14. Since electrical cord 20 is a conventional electrical cord which is well known in the art, electrical cord 20 will not be discussed or illustrated in detail herein.

Figure 5:
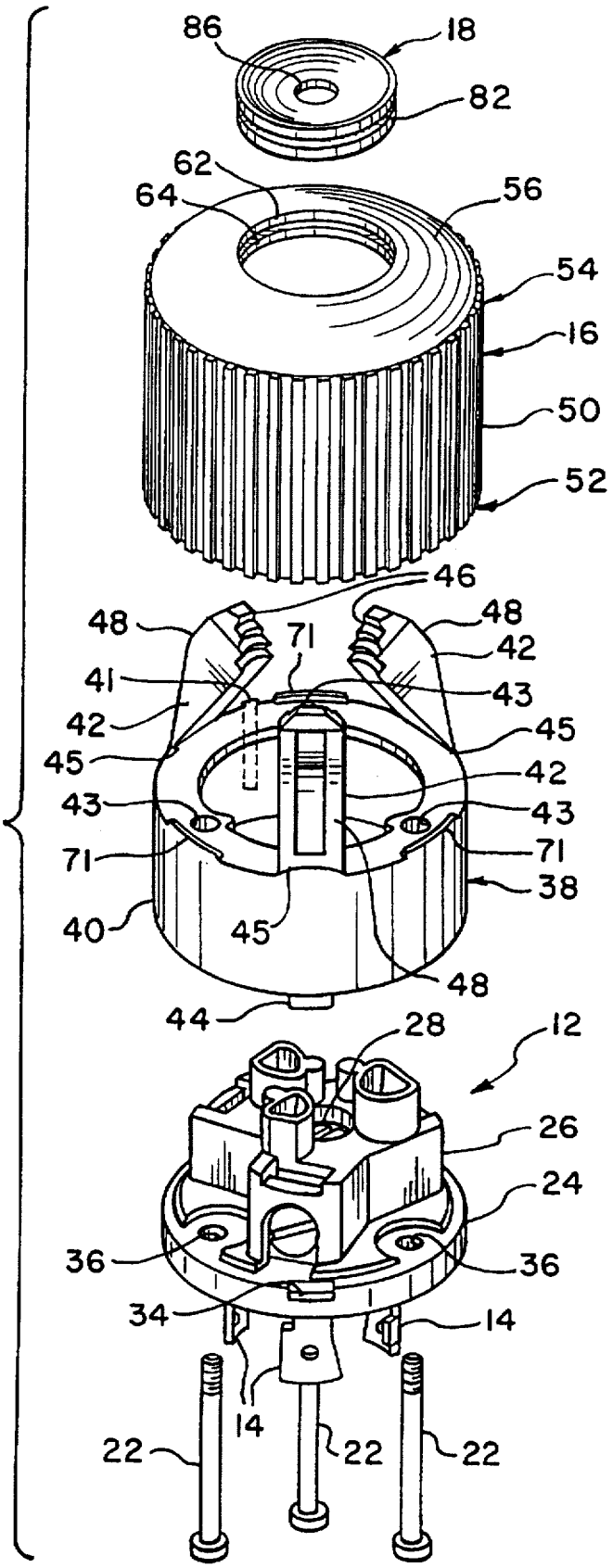
FIG. 5 is an exploded top end perspective view of the electrical connector illustrated in FIGS. 1–4.

Contact retainer body 12 is releasably coupled to cover 16 via three longitudinally extending screws or fasteners 22 and dimensioned to fit inside of cover 16 as explained below in more detail. Contact retainer body 12 basically includes a base 24 and a terminal housing 26 which are coupled together via a screw 28 as seen in FIG. 5. Electrical contacts 14 are maintained within contact retainer body 12, with one of the ends of electrical contacts 14 extending outwardly from base 24.

Figure 4:
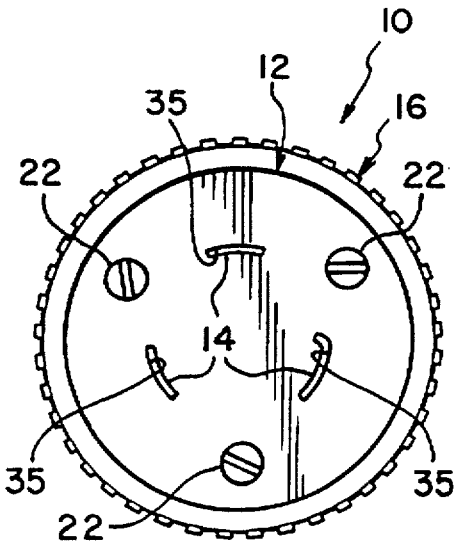
FIG. 4 is a bottom end plan view of the electrical connector illustrated in FIGS. 1–3.

Referring to FIGS. 4 and 5, base 24 is preferably a substantially disc-shaped member constructed of a hard, rigid plastic material such as nylon. A notch 34 is provided in base 24 for engaging gripper 38 to ensure proper orientation of contact retainer body 12 with gripper 38. Base 24 has three contact openings 35 for receiving the end of electrical contacts 14 therethrough as well as three bores 36 (only two shown) for receiving screws 22 thereto for coupling base 24 to cover 16.

As seen in FIG. 4, terminal housing 26 is constructed of a hard, rigid plastic material for housing the terminal ends of electrical contacts 14 which are attached to the ends of the electrical conductors 20*a*, 20*b* and 20*c* of electrical cord 20. Preferably, terminal housing 26 is constructed of a see-through or transparent material to allow visual inspection of the electrical connections between the terminals ends of electrical contacts 14 and the ends of the electrical conductors 20*a*, 20*b*, 20*c* of electrical cord 20. Terminal housing 26 is of relatively conventional construction, and thus, terminal housing 26 will not be discussed or illustrated in further detail herein.

Electrical contacts 14 are conventional blade contacts, which are well known in the art, and thus, electrical contacts 14 will not be illustrated or discussed in detail herein. Electrical contacts 14 are constructed of a conductive material and are coupled to the exposed ends of the electrical conductors of electrical cord 20. In the preferred embodiment illustrated in the drawings, electrical contacts 14 are curved such that electrical connector 10 is a locking type connector.

Electrical connector 10 can also be provided with a cord gripper 38 which cooperates with cover 16, as discussed below, to provide strain relief for the connection between the end of electrical cord 20 and electrical contacts 14. A similar cord grip is disclosed in U.S. Pat. No. 3,437,980 to Smith, the entire disclosure of which is hereby incorporated herein by reference.

As seen in FIG. 5, cord gripper 38 is a substantially tubular member having a tubular body portion 40 with a longitudinally extending polarizing member or rib 41 on its outer surface, and three cord gripping fingers 42. Tubular body portion 40 also includes three axially extending tubular bores 43 for receiving screws 22 therethrough. Bores 43 are preferably spaced approximately 120° apart and extend the entire length of gripper 38. Gripper 38 is dimensioned to be non-rotatably received within cover 16. Specifically, polarizing rib 41 of gripper 38 engages cover 16 to prevent relative rotation therebetween and to ensure proper orientation of cover 16 relative to gripper 38. A tab 44 is provided on the end of gripper 38 for engaging notch 34 of base 24 to prevent relative rotation therebetween as well as to ensure proper orientation of contact retainer body 12 with gripper 38 and cover 16. Preferably, gripper 38 is integrally formed as a one-piece, unitary member constructed of a substantially hard, rigid plastic material such as nylon.

The cord gripping fingers 42 are each integrally formed on one end of tubular body portion 40 by a living hinge 45 and spaced approximately 120° apart. The cord gripping fingers 42 generally extend in the axial direction of electrical connector 10, but are slightly angled inwardly towards the central longitudinal axis of electrical connector 10 to form an acute angle with a plane extending substantially perpendicular to the longitudinal axis of electrical connector 10.

The living hinges 45 are integrally formed between tubular body portion 40 and cord gripping fingers 42 by a thin piece of material located at the intersection of the cord gripping fingers 42 and the tubular body portion 40. These living hinges 45 allow the cord gripping fingers 42 to swing or pivot towards and away from the center axis of electrical connector 10. The free end of cord gripping fingers 42 can be provided with serrations or grooves 46 for engaging and firmly gripping electrical cord 20. The outer surfaces 48 of cord gripping fingers 42 are angled to form inclined planes which slope towards the center axis of electrical connector 10. Cord gripping fingers 42 are designed to engage the interior of cover 16 during assembly such that cord gripping fingers 42 are pivoted inwardly to grip electrical cord 20 as discussed below in more detail.

Figure 11:
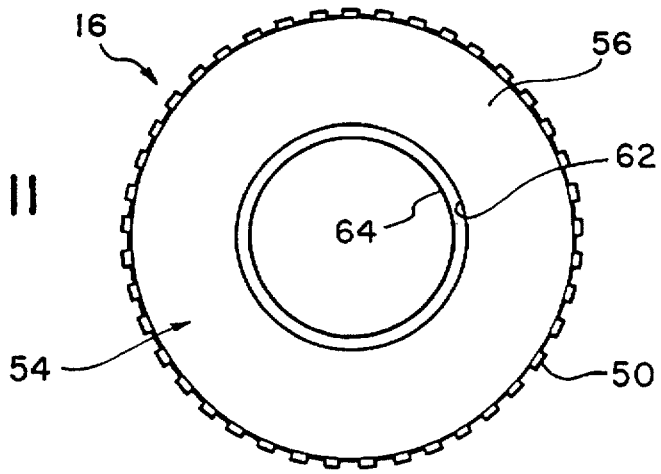
FIG. 11 is a top end plan view of the cover for the electrical connector illustrated in FIGS. 1–6 with the cord seal removed.
Figure 12:
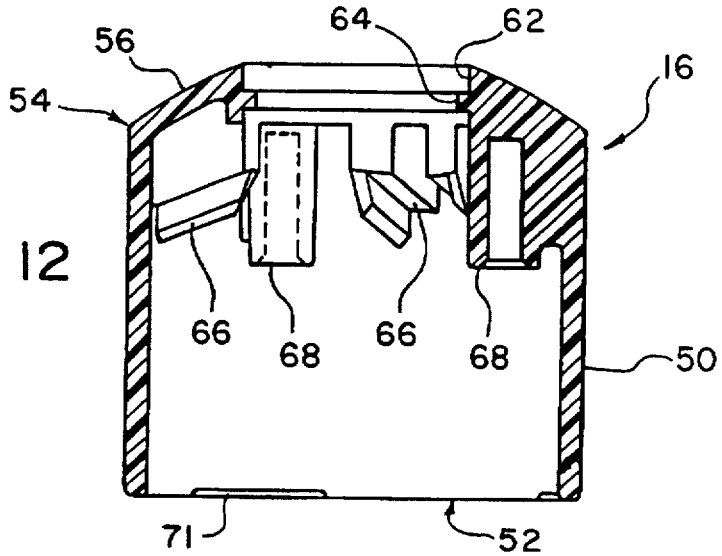
FIG. 12 is a longitudinal cross-sectional view of the cover for the electrical connector illustrated in FIGS. 1–6.
Figure 13:
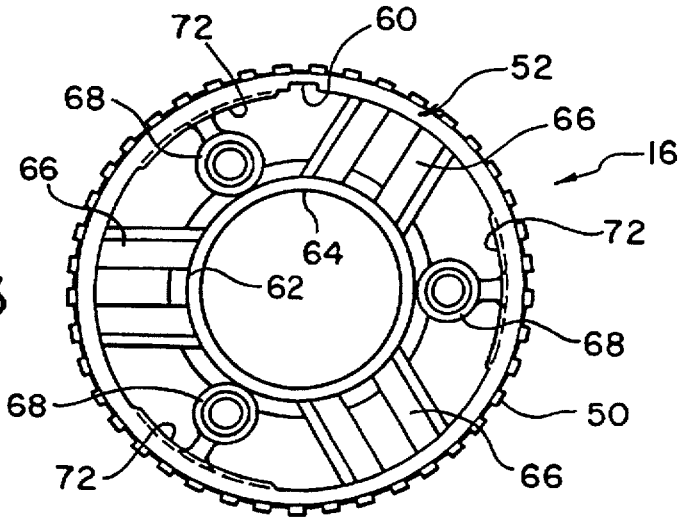
FIG. 13 is a bottom end plan view of the cover for the electrical connector illustrated in FIGS. 1–6 with the cord seal removed.
Figure 14:
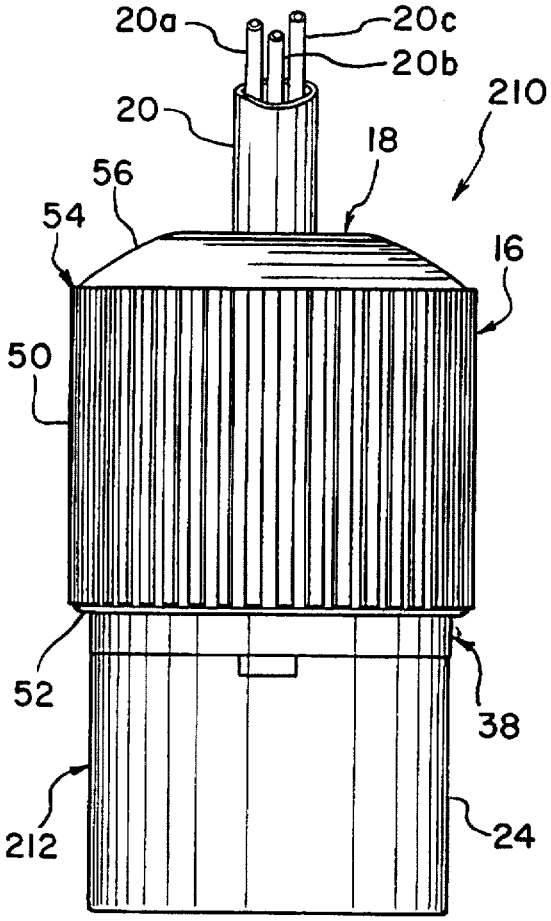
FIG. 14 is a side elevational view of an electrical connector in the form of a female connector in accordance with a second embodiment of the present invention.
Figure 15:
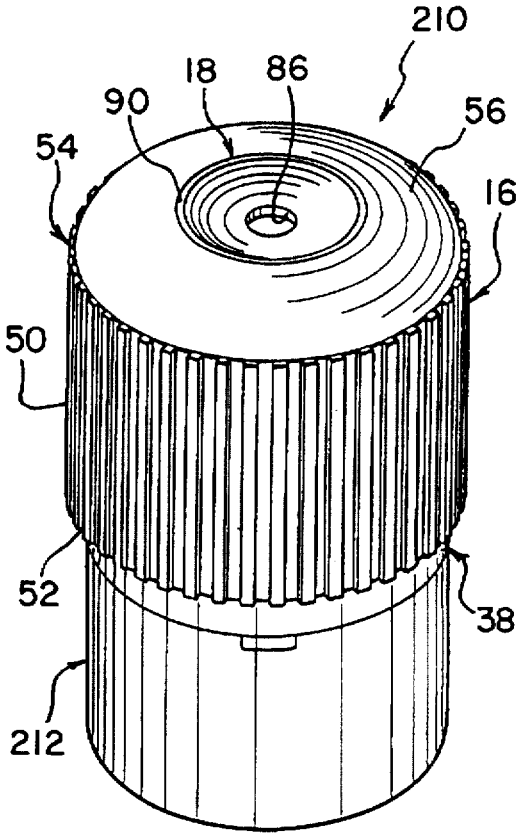
FIG. 15 is a top end perspective view of the female electrical connector illustrated in FIG. 14.
Figure 16:
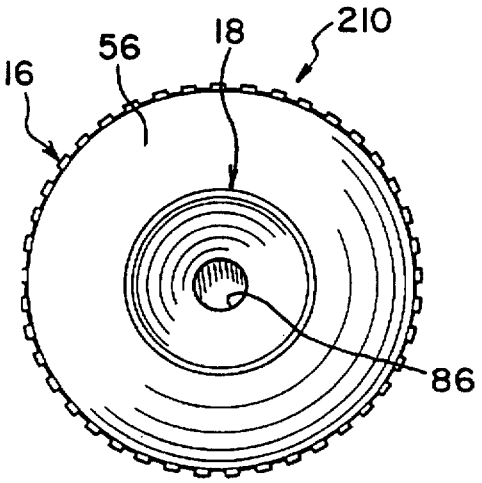
FIG. 16 is a top end plan view of the female electrical connector illustrated in FIGS. 14 and 15 with the electrical cord removed.
Figure 17:
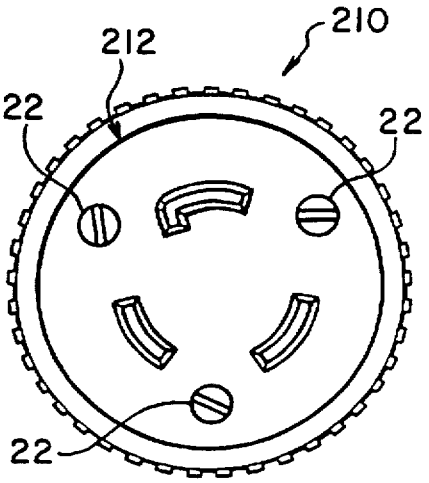
FIG. 17 is a bottom end plan view of the female electrical connector illustrated in FIGS. 14–16.
Figure 18:
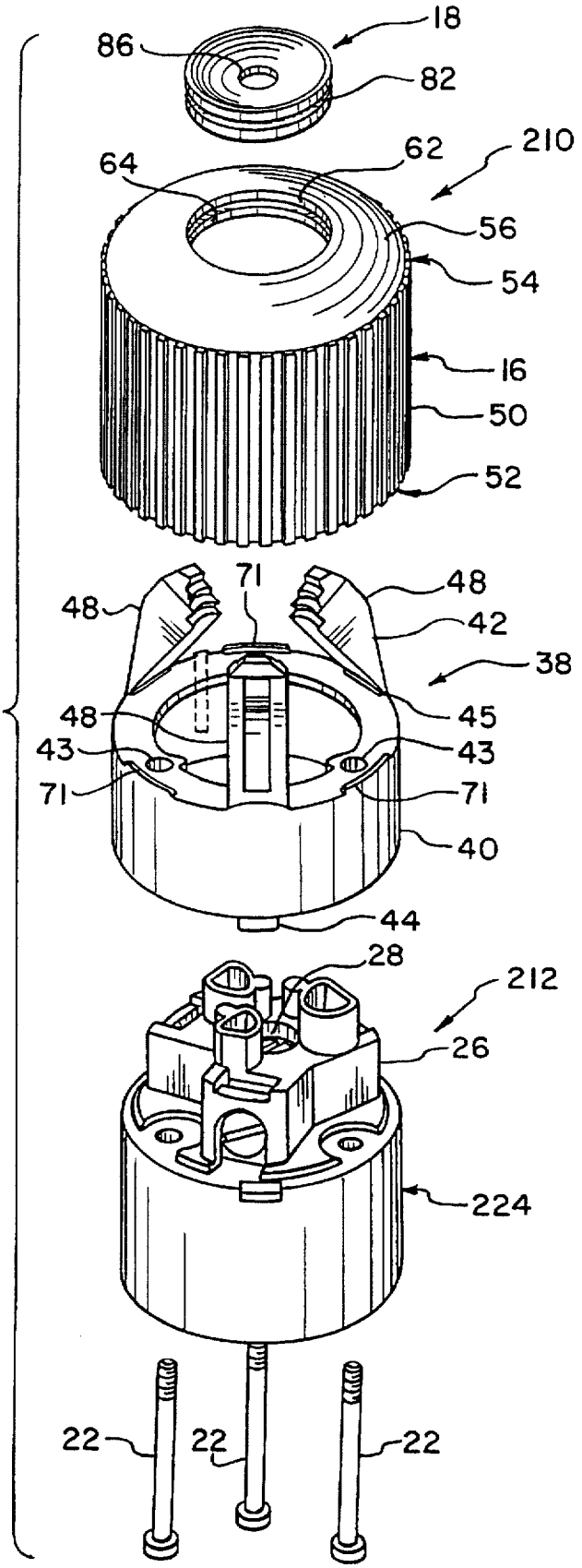
FIG. 18 is a exploded top end perspective view of the female electrical connector illustrated in FIGS. 14–17.

As seen in FIGS. 10–12, cover 16 is preferably integrally formed as a one-piece, unitary member constructed of a substantially hard, rigid plastic material such as nylon. Cover 16 is preferably a substantially cylindrical member having a tubular portion 50 with a first open end 52 for receiving gripper 38 therein and a second partially closed end 54 with cord seal 18 coupled thereto. The interior surface of tubular portion 50 is provided with a polarizing member or slot 60 for ensuring correct orientation of gripper 38 relative to cover 16.

Closed end 54 is formed by a radially inwardly extending end wall 56. End wall 56 has a centrally located opening 62 for receiving and securing cord seal 18 therein. In particular, opening 62 is preferably a substantially circular opening centered on the center longitudinal axis of electrical connector 10. The inner surface of circular opening 62 has a continuous, annular rib or flange 64 extending radially inwardly therefrom for engaging and coupling cord seal 18 to cover 16. Rib 64 has an inner diameter of about 0.967 inches, while opening 62 preferably has an inner diameter of about 1.087 inches.

The exterior surface of end wall 56 is preferably spherical as it extends between tubular portion 50 and opening 62. For example, the exterior surface of end wall 56 has a radius of curvature of about 1.650 inches. The spherical exterior surface of end wall 56 aids in preventing electrical connector 10 from being snagged.

The interior surface of end wall 56 and tubular portion 50 is provided with three ramps 66 for engaging cord gripping fingers 42 to pivot or swing cord gripping fingers 42 inwardly to grip electrical cord 20. In other words, ramps 66 are dimensioned to engage cord gripping fingers 42 when the cover 16 and contact retainer body 12 are coupled together by screws 22. More specifically, when screws 22 are tightened, cover 16 moves axially towards gripper 38 and contact retainer body 12 which in turn causes cord gripping fingers 42 to engage ramps 66. Since ramps 66 are inclined inwardly towards the longitudinal axis of electrical connector 10, cord gripping fingers 42 rides along ramps 66 and pivot inwardly to grip electrical cord 20.

The inner surface of end wall 56 is also provided with three internally threaded posts 68 which are integrally formed on the interior of end wall 56. Post 68 is preferably spaced 120° apart so that they are aligned with bores 36 of base 24 and bores 43 of gripper 38 to threadedly receive screws 22 therein. It will be apparent to those skilled in the art that since cover 16 is constructed of plastic that posts 68 can be initially unthreaded and subsequently tapped by screws 22 during assembly of electrical connector 10.

To assist in attachment of electrical connector 10 to electrical cord 20, gripper 38 is preferably provided with three outwardly extending lips 71 which are adapted to engage the three radially inwardly extending lips 72 formed on the inner surface of tubular portion 50 adjacent its first open end 52. Lips 71 of gripper 38 and lips 72 of cover 16 are dimensioned such that gripper 38 is received within the interior of tubular portion 50 of cover 16 via a snap-fit. Thus, once gripper 38 is inserted into the interior of cover 16, gripper 38 is releasably retained to cover 16.

As mentioned above, cover 16 and gripper 38 can also both be provided with a pair of complimentary polarizing members 60 and 41, respectively, to ensure proper assembly and orientation of gripper 38 relative to cover 16. In particular, polarizing member 60 of cover 16 is in the form of a longitudinally extending slot 60 formed in the interior surface of tubular portion 50, while complimentary polarizing member 41 of gripper 38 is a longitudinally extending rib 41 formed on the exterior surface of gripper 38. It is important that gripper 38 and cover 16 are in the proper orientation so that cord gripping fingers 42 will properly engage ramp 66 and bores 43 of gripper 38 will align with the bores of the internally threaded post 68 of cover 16.

Referring now to FIGS. 6–10, cord seal 18 is preferably constructed of an elastomeric material such as a thermoplastic elastomer which has sufficient flexibility and resiliency for sealing the interface between opening 62 of cover 16 and the outer surface of electrical cord 20. Cord seal 18 is press fitted in opening 62 of cover 16 to fixedly retain cord seal 18 therein. Cord seal 18 has a tubular portion 80 with a continuous, annular recess 82 formed therein and an inwardly extending diaphragm portion 84 defining a center circular opening or aperture 86 for receiving electrical cord 20 therethrough.

Tubular portion 80 has a cylindrical outer peripheral surface 88 with a substantially circular transverse cross-section. Tubular portion 80 is preferably concentric with the longitudinal axis of electrical connector 10. Annular recess 82 is dimensioned to receive rib 64 of the end wall 56 of cover 16 to fixedly secure cord seal 18 within opening 62. Preferably, the axial widths of recess 82 and rib 64 are substantially equal to each other. The outer diameter of recess 82 is preferably slightly less than or equal to the inner diameter of rib 64. For example, the outer diameter of recess 82 could be about 0.962 inches, while the inner diameter of rib 64 could be about 0.967 inches. Of course, the clearance between recess 82 of cord seal 18 and rib 64 of cover 16 can be such that an interference fit occurs therebetween.

When cord seal 18 is properly positioned in opening 62 of cover 16, outer peripheral surface 88 will substantially be in intimate contact with end wall 56 of cover 16 to provide a substantially smooth and flush interface therebetween. Thus, no abrupt changes occur between the transition of cover 16 and cord seal 18. Preferably, the outer diameter of cord seal 18 is equal to or slightly smaller than the inner diameter of the opening 62 formed by end wall 56 of cover 16. For example, the outer diameter of cord seal 18 could be about 1.082 inches, while the inner diameter of opening 62 could be about 1.087 inches. Of course, the outer diameter of cord seal 18 could be greater than the inner diameter of opening 62 to create an interference fit therebetween.

Diaphragm portion 84 of cord seal 18 is integrally formed at one end of tubular portion 80 of cord seal 18, and has a substantially smooth outer end surface. The outer end surface of diaphragm portion 84 preferably has a first spherical section 90 formed at the intersection of the outer end surface of diaphragm portion 84 with outer peripheral surface 88 of tubular portion 80 such that this first spherical section 90 is substantially flush and contiguous with the exterior surface of the end wall 56 of cover 16. In other words, the geometry of the exterior surface of end wall 56 of cover 16 blends with the geometry of first spherical section 90 of cord seal 18. This increases the difficulty of removal of the cord seal 18 from opening 62 in cover 16. Of course, it is also possible to have the first spherical portion 90 slightly recessed from the exterior surface of end wall 56 to further prevent easy removal of cord seal 18 from opening 62.

Outer end surface of diaphragm portion 84 also has a second frustoconical section 92 which slopes radially inwardly from first spherical section 90 and towards the interior of cover 16. Again, the second frustoconical section 92 of the outer end surface of cord seal 18 is also designed to prevent easy removal of cord seal 18 from opening 62 of cover 16, since it slopes inward into end wall 56 of cover 16. In a less preferred embodiment, it will be apparent to those skilled in the art that sections 90 and 92 could be replaced with a substantially planar section which extends perpendicular to the longitudinal axis of electrical connector 10.

Installation of Electrical Connector 10

Electrical connector 10 is installed on the end of electrical cord 20 by first unscrewing the three screws 22 to separate contact retainer body 12 from cover 16 and gripper 38, if not already separated. Typically, electrical connector 10 is sold with contact retainer body 12 separated from cover 16. Also, contact retainer body 12 is typically sold such that base 24 and terminal housing 26 are typically pre-coupled together by screw 28 at the factory such that the electrical contacts 14 are retained therebetween. Thus, the electrical cord 20 is readily connected to electrical contacts 14 without disassembling contact retainer body 12. Also, cover 16 and gripper 38 are also typically pre-coupled together via lips 71 and 72.

Electrical cord 20 is inserted through aperture 86 in cord seal 18 which causes diaphragm portion 84 to be elastically deformed to create a seal therebetween. Now, the ends of the electrical conductors 20*a*, 20*b*, 20*c* of the electrical cord 20 are coupled to the terminals of electrical contacts 14 in a conventional manner. Then, contact retainer body 12 can be attached to the cover 16 and gripper 38 via screws 22. In particular, screws 22 are inserted through bores 43 of gripper 38 and then threaded into posts 68 of cover 16. This assembly of contact retainer body 12 to cover 16 and gripper 38, causes gripper 38 to move axially within the interior of cover 16 such that the cord gripping fingers 42 ride along ramp 66 of cover 16 so that they are pivoted inwardly against electrical cord 20. The cord gripping fingers 42 engage and firmly hold the electrical cord 20 within electrical connector 10 to provide strain relief between the ends of the electrical conductors and the terminals of the electrical contacts 14.

Electrical Connector 210

Referring now to FIGS. 14–18, an electrical connector 210 in accordance with a second embodiment is illustrated. Electrical connector 210 is substantially identical to electrical connector 10, discussed above, except that electrical connector 210 is a female electrical connector having a modified contact retainer body 212 with an elongated base 224 for accommodating female electrical contacts 214 therein. Thus, female electrical connector 210 will not be discussed or illustrated in detail herein. Rather, the parts of electrical connector 210 which are the same as the parts of electrical connector 10 will be identified with the same reference numeral in referring to electrical connector 210.

Electrical connector 210 basically includes a contact retainer body 212 with three electrical contacts 214, a cover 16 coupled to contact retainer body 212 and a cord seal 18 coupled to cover 16. Electrical connector 210 further preferably also includes a gripper 38 as discussed above. Electrical connector 210 is also electrically coupled to the end of an electrical cord 20 in a substantially conventional manner as mentioned above.

While only two advantageous embodiments have been chosen to illustrate the invention, it will be understood by those skilled in the art once given this disclosure that various changes and modifications can be made herein without departing from the scope of the invention as defined in the appended claims.

What is claimed is:

1. An electrical connector for attachment to an end of an electrical cord comprising:

a connector body having a plurality of electrical contacts mounted thereto, said contacts being adapted to be coupled to the end of the electrical cord;

a cover having a tubular sidewall with a first end and a second end, said first end of said cover being coupled to said connector body and said second end having an inwardly extending end wall with an exterior surface defining a centrally located opening for receiving the electrical cord therethrough; and a removable resilient cord seal fixedly coupled within said opening of said cover, said cord seal having an outer peripheral surface engaging an inner peripheral surface of said opening in said end wall to form a seal therebetween and a centrally located aperture for receiving the end of the electrical cord therethrough to form a seal therebetween, said outer peripheral surface of said cord seal being located entirely within said opening of said cover, said cord seal having an outer end surface extending between said outer peripheral surface and said aperture, said outer end surface of said cord seal being substantially contiguous with respect to said exterior surface of said cover to form a substantially smooth interface with said exterior surface to increase difficulty of removal of said cord seal from said opening in said end wall of said cover, said inner peripheral surface of said opening being configured to matingly engage said outer peripheral surface of said cord seal to secure said cord seal within said opening via a protrusion and recess connection formed on said peripheral surfaces.

2. An electrical connector according to claim 1, wherein said exterior surface of said end wall of said cover is spherically shaped with a first radius of curvature.

3. An electrical connector according to claim 2, wherein said cord seal has a tubular portion with an axial length forming said outer peripheral surface and said recess, and an inwardly extending diaphragm portion defining part of said outer end surface and said aperture of said cord seal.

4. An electrical connector according to claim 2, wherein said outer end surface of said cord seal has a spherically shaped section adjacent said outer peripheral surface of said cord seal.

5. An electrical connector according to claim 4, wherein said spherically shaped portion of said cord seal has a second radius of curvature which is substantially equal to said first radius of curvature of said exterior of said end wall.

6. An electrical connector according to claim 5, wherein said cord seal is constructed of an elastomeric material.

7. An electrical connector according to claim 5, wherein said outer peripheral surface of said cord seal has a said recess formed therein for receiving said protrusion of said end wall of said cover therein.

8. An electrical connector according to claim 7, wherein said outer peripheral surface of said cord seal is substantially circular in cross-section.

9. An electrical connector according to claim 8, wherein said recess is a substantially continuous annular recess and said protrusion of said end wall is a complimentary annular flange.

10. An electrical connector according to claim 9, wherein said cord seal has a tubular portion with an axial length forming said outer peripheral surface and said recess, and an inwardly extending diaphragm portion defining part of said outer end surface and said aperture of said cord seal.

11. An electrical connector according to claim 10, wherein said outer end surface further includes a frustoconical portion which is angled toward said connector body as said frustoconical portion approaches said aperture of said cord seal.

12. An electrical connector according to claim 11, wherein said connector body is coupled within said first end of said cover by a plurality of screws.

13. An electrical connector according to claim 12, wherein said connector body includes a cord grip for engaging and retaining the electrical cord to prevent longitudinal movement of the end of the electrical cord relative to said electrical contacts.

14. An electrical connector according to claim 13, wherein said connector body and said cover each includes a polarizing member for engaging each other to ensure correct orientation of said connector body and said cover during assembly.

15. An electrical connector according to claim 14, wherein said cover further includes at least one inwardly extending lip and said connector body further includes at least one outwardly extending lip for releasably engaging said lip of said cover via a snap-fit during assembly of said cover and said connector body together.

* * * * *